US008434385B2

(12) United States Patent
Mo

(10) Patent No.: US 8,434,385 B2
(45) Date of Patent: May 7, 2013

(54) PEDAL DEVICE WITH FUNCTION OF ADJUSTING PEDAL EFFORT AND HYSTERESIS

(75) Inventor: Yonghwan Mo, Ulsan (KR)

(73) Assignee: Donghee Industrial Co., Ltd., Ulsan (KR)

( * ) Notice: Subject to any disclaimer, the term of this patent is extended or adjusted under 35 U.S.C. 154(b) by 980 days.

(21) Appl. No.: 12/114,626

(22) Filed: May 2, 2008

(65) Prior Publication Data

US 2008/0276752 A1 Nov. 13, 2008

(30) Foreign Application Priority Data

May 11, 2007 (KR) ..... 10-2007-0045873

(51) Int. Cl.
*G05G 1/30* (2008.04)

(52) U.S. Cl.
USPC ..... 74/513; 74/512; 74/560

(58) Field of Classification Search ..... 74/512–514, 74/560, 562; 280/291, 294
See application file for complete search history.

(56) References Cited

U.S. PATENT DOCUMENTS 2,202,928 A * 6/1940 Shaw ..... 411/305
4,161,341 A * 7/1979 Reinecke et al. ..... 303/52
6,666,106 B1 * 12/2003 Hueges et al. ..... 74/514
7,278,337 B2 10/2007 Solta
7,296,494 B2 11/2007 Caba et al.
2001/0015111 A1 * 8/2001 Rixon et al. ..... 74/512
2004/0065167 A1 * 4/2004 Kim ..... 74/560

FOREIGN PATENT DOCUMENTS

JP 56021941 A * 2/1981
JP 11-342762 A 12/1999
KR 10-2005-0048817 A 5/2005
KR 10-2006-0016380 A 2/2006

* cited by examiner

*Primary Examiner* — Phillip A Johnson
*Assistant Examiner* — Daniel Yabut
(74) *Attorney, Agent, or Firm* — LRK Patent Law Firm

(57) ABSTRACT

A pedal device which can alleviate fatigue of a driver's ankle due to frequent acceleration by varying the amount of reaction force applied when the driver presses and releases a pedal by adjusting a pre-compression force against a return spring disposed at a hinged portion of a pedal arm and adjusting a friction force on a pivot end of the pedal arm. The pedal device includes a housing fixed to a car body, an arm hinged to the housing, an elastic member disposed at the hinged portion between the housing and the pedal arm, a pedal effort adjusting unit disposed at the pedal arm and pressing an end of the elastic member, and a hysteresis adjusting unit movably disposed at the housing to press a pivot end of the pedal arm and adjusting the amount of change in stroke-to-pedal effort when the pedal arm operates.

9 Claims, 11 Drawing Sheets

PEDAL DEVICE WITH FUNCTION OF ADJUSTING PEDAL EFFORT AND HYSTERESIS

CROSS-REFERENCE TO PRIORITY APPLICATION

The benefit of priority is claimed to Republic of Korea patent application number 10-2007-0045873, filed May 11, 2007, which is hereby incorporated by reference in its entirety.

BACKGROUND

1. Field of the Invention

The present invention relates to a pedal device of a vehicle, and more particularly, to an electronic pedal device detecting a level of stepping by pressing a pedal to generate an electrical signal, which can promote a change of characteristics of a pedal effort and hysteresis adapted to a driver's propensity by adjusting an elastic force of a return spring disposed at a hinged portion of a pedal arm and providing a returning force, and a friction force on a pivot end of the pedal arm.

2. Description of the Related Art

In general, a vehicle traveling is accelerated when the driver presses the pedal device and the pedal device is frequently pressed by the driver while the vehicle is traveling; therefore, research to improve the pedal response is being conducted.

Further, the pedal device for acceleration is mainly divided into a mechanical type and an electronic type. The mechanical acceleration pedal device includes an acceleration pedal that is pivotably mounted inside the vehicle room, a throttle mechanism that is provided in the intake system in the engine room, and a cable that is provided to transmit an operational force between the acceleration pedal and the throttle mechanism, connecting them.

On the other hand, an electronic acceleration pedal device includes an acceleration pedal that is pivotably mounted in the vehicle room, a pivot angle detecting sensor, such as a potentiometer, which is attached to the acceleration pedal to detect in real time the amount of pivots of the acceleration pedal.

However, in the acceleration pedal devices as described above in the related art, according to the mechanical acceleration pedal device, a hysteresis, when a reaction force applied to the driver pressing the pedal is smaller than a reaction force applied to the driver releasing the pedal due to the friction between a wire and a tube in the cable at the same time the pedal is being pressed and released, is caused. However, this has minimal effect on tuning the pedal effort.

On the contrary, according to the electronic acceleration pedal device in the related art, the amount of reacting force applied when the driver presses or releases a pedal depends on only the natural elasticity of the return spring that elastically returns the pedal arm, and the amount of reacting force is set on the basis of the pressing force for acceleration rather than on the basis of the releasing. Therefore, the electronic acceleration pedal device that generates the same magnitude of reacting force while pressing and releasing the pedal in the related art, increases the fatigue of the driver's ankle as the driver repeatedly presses and releases the pedal. As a result, this deteriorates the response of the pedal.

Further, since the reacting force depends on the natural elasticity of the return spring in the electronic acceleration pedal device in the related art, it is difficult to freely perform the tuning of pedal effort according to the driver's preference.

SUMMARY

Accordingly, the present invention is made to solve the above-mentioned problems, an object of the present invention is to provide an electronic type pedal device detecting a level of stepping by pressing a pedal to generate an electrical signal, which can alleviate fatigue of a driver's ankle due to a frequent acceleration operation by differently setting a level of reaction that is applied to the driver at the time of stepping and releasing a pedal by adjusting a pre-compression force to a return spring disposed at a hinged portion of a pedal arm and adjusting a friction force at a pivot end portion of the pedal arm, satisfying a user's preference by appropriately adjusting the reaction force.

In order to accomplish the above object, the present invention provides a pedal device with a function of adjusting a pedal effort and hysteresis, the pedal device including: a housing fixed to a car body; an arm hinged to the housing; an elastic member disposed at the hinged portion between the housing and the pedal arm, and providing a return force to the pedal arm; a pedal effort adjusting unit disposed at the pedal arm and pressing an end of the elastic member to adjust a pre-compression force to the elastic member; and a hysteresis adjusting unit movably disposed at the housing to press a pivot end of the pedal arm and adjusting the amount of change in stroke-to-pedal effort when the pedal arm operates.

BRIEF DESCRIPTION OF THE DRAWINGS

The above and other features and advantages of the present discussion will become more apparent by describing in detail preferred embodiments thereof with reference to the attached drawings in which.

DETAILED DESCRIPTION

Hereinafter, embodiments of the invention are described in detail with reference to the accompanying drawings.

Figure 1:
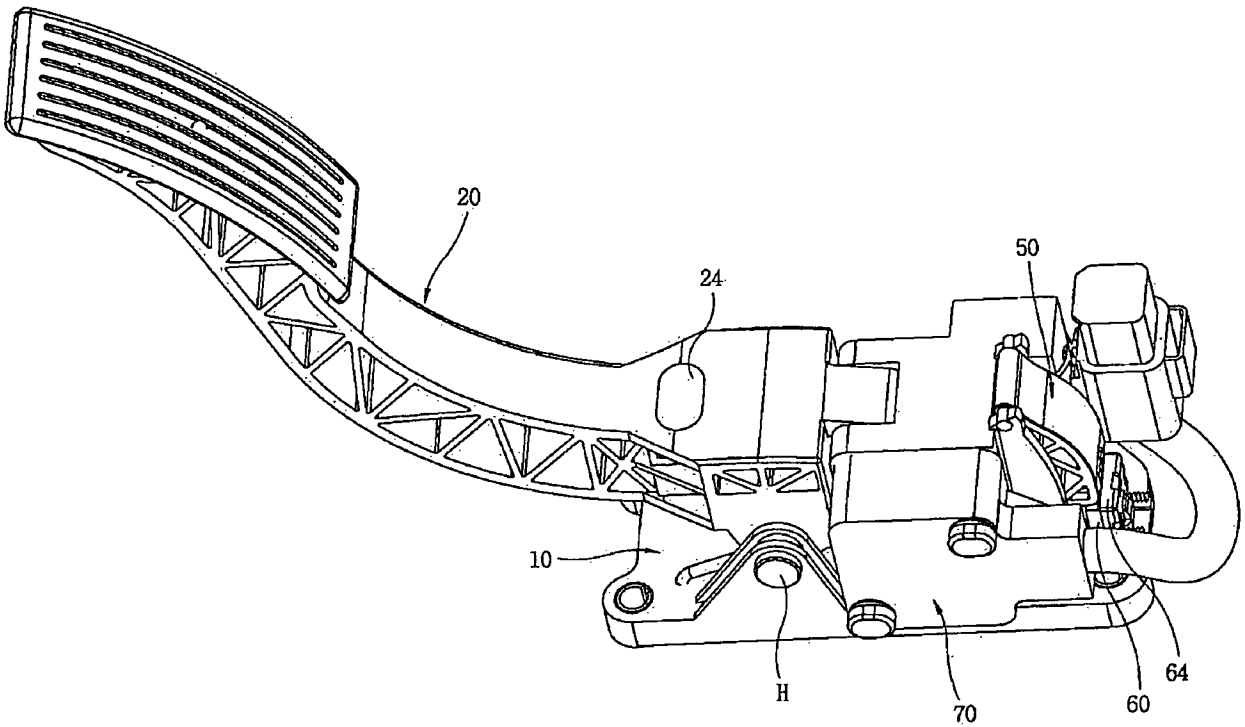
FIG. 1 is a perspective view illustrating a configuration of a pedal device with a function of adjusting a pedal effort and hysteresis according to an embodiment of the present invention.
Figure 2:
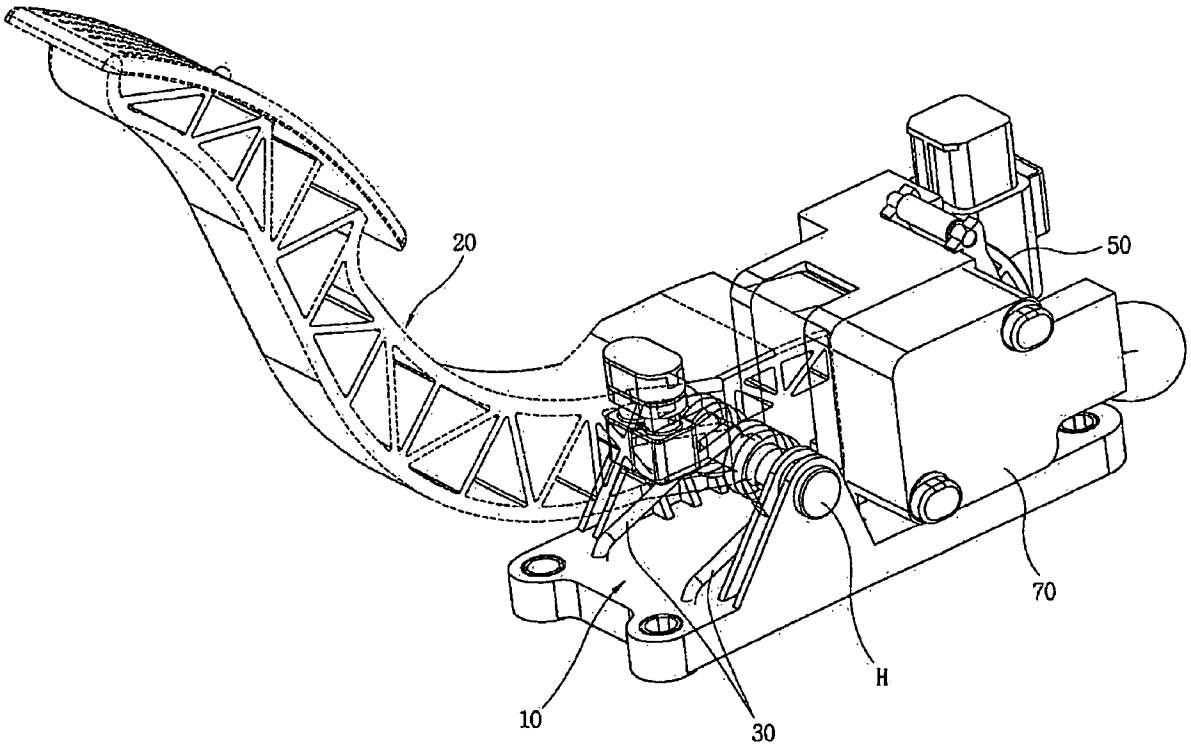
FIG. 2 is a view showing the main part of FIG. 1, indicated by an imaginary line, to illustrate the configuration of a pedal effort adjusting unit.
Figure 3:
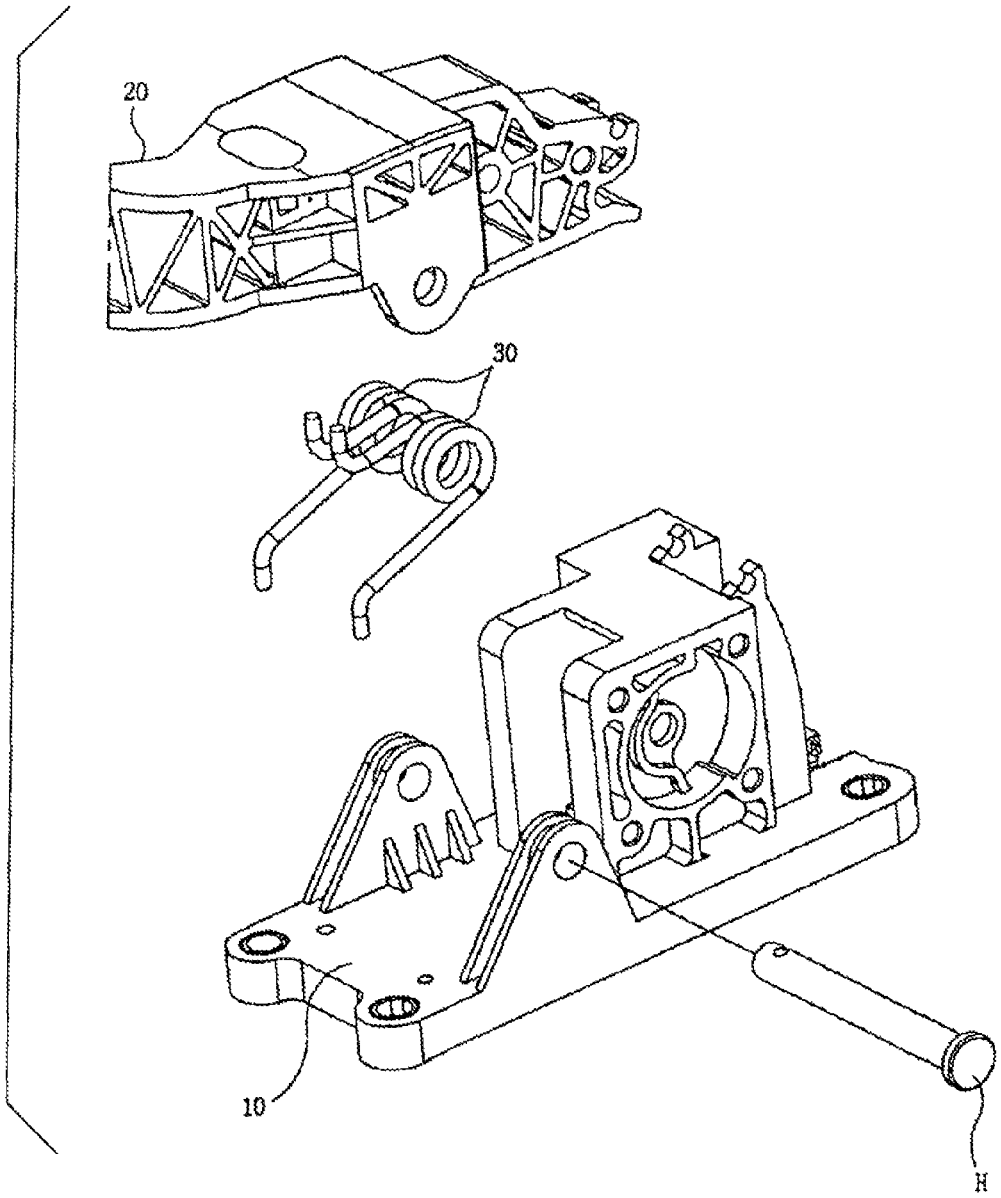
FIG. 3 is an exploded perspective view showing a torsion spring that has been mounted.

As shown in FIGS. 1 to 3, an electronic pedal device according to an embodiment of the invention includes a housing 10 fixed to a car body, a pedal arm 20 connected to the housing 10 by a hinge pin H, and an elastic member disposed at the hinged portion between the housing 10 and the pedal arm 20, and providing a return force to the pedal arm 20.

Further, the electronic pedal device according to an embodiment of the invention further includes a pedal effort adjusting unit and a hysteresis adjusting unit. The pedal effort adjusting unit is disposed at the pedal arm 20 and presses an end of the elastic member to adjust a pre-compression force to the elastic member, thereby adjusting a pedal effort to the pedal arm 20. The hysteresis adjusting unit is movably disposed at the housing 10 to press a pivot end of the pedal arm 20 and adjusts the amount of change in stroke-to-pedal effort when the pedal arm 20 pivots and returns.

The elastic member is disposed at the hinged portion between the housing 10 and the pedal arm 20. More specifically, the elastic member is composed of torsion springs with an end fixed to the pedal arm 20 and the other end fixed to the pedal arm 20. That is, the torsion springs 30 are fitted on and supported by the hinge pin H at the hinged portion between the housing 10 and the pedal arm 20.

Figure 4:
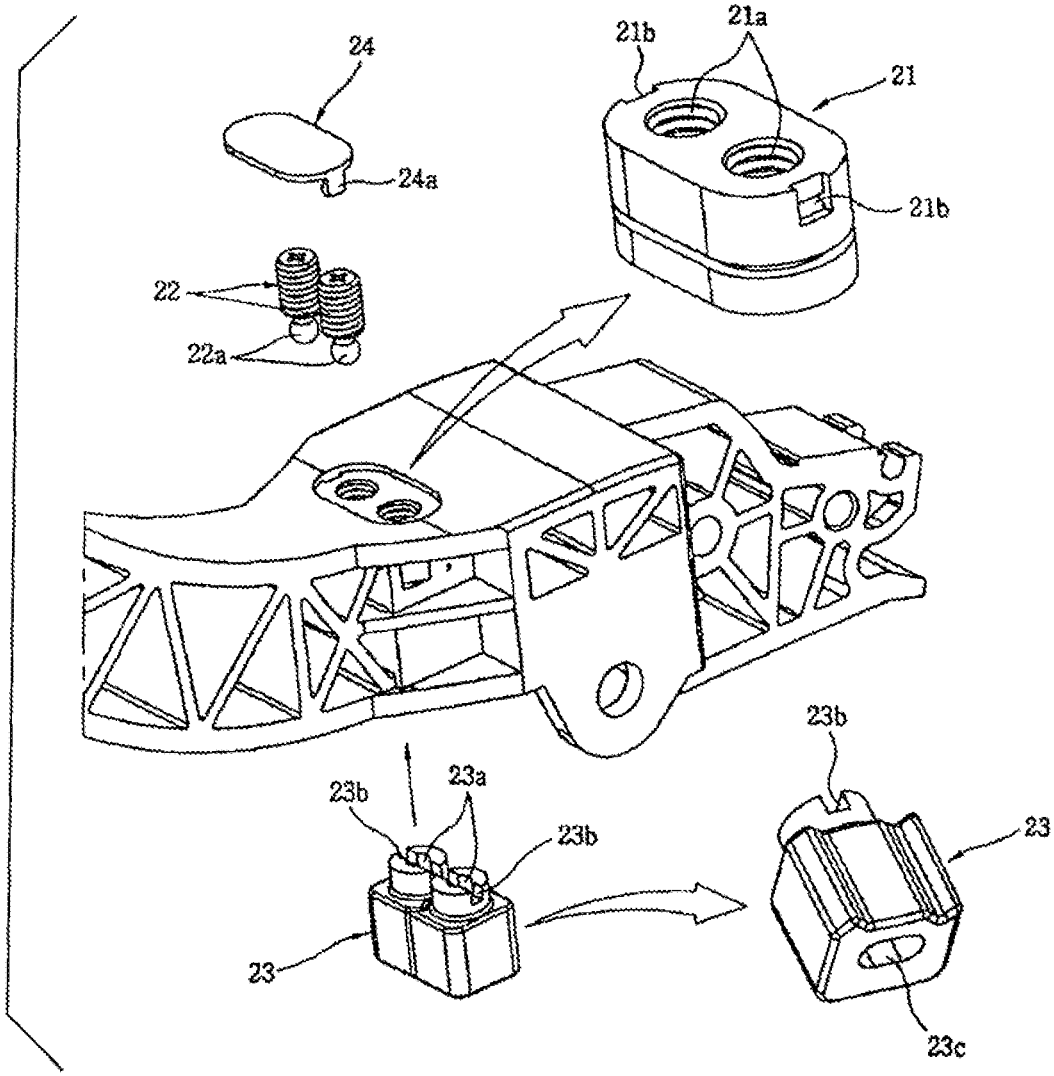
FIG. 4 is an exploded perspective view illustrating the configuration of the pedal effort adjusting unit.
Figure 5:
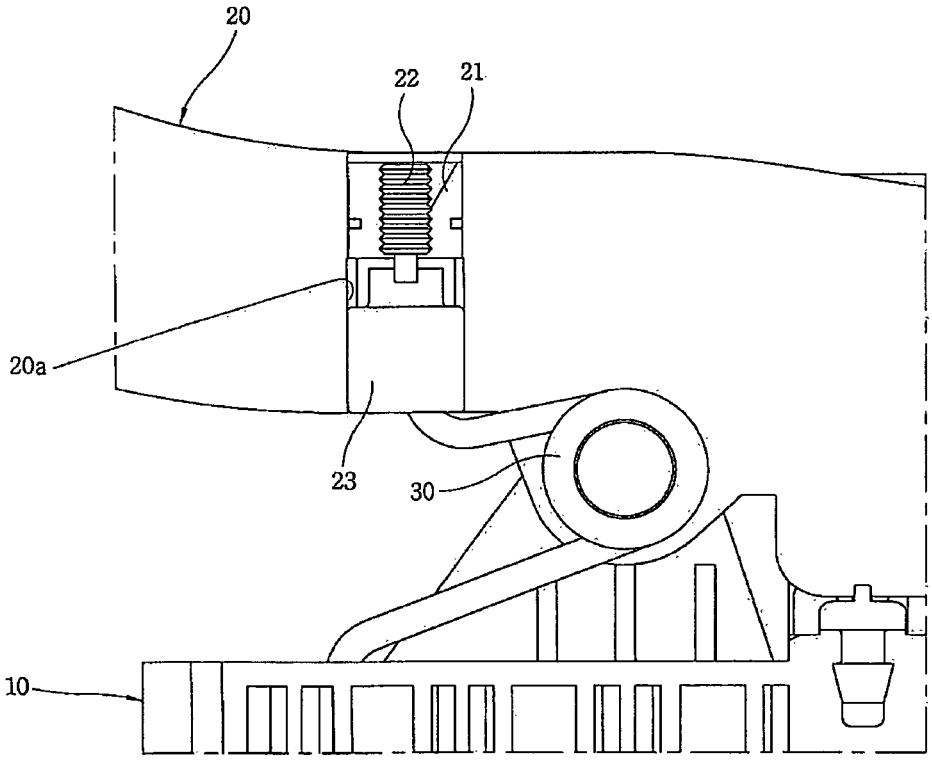
FIG. 5 is a cross-sectional view illustrating the configuration of the pedal effort adjusting unit.
Figure 6:
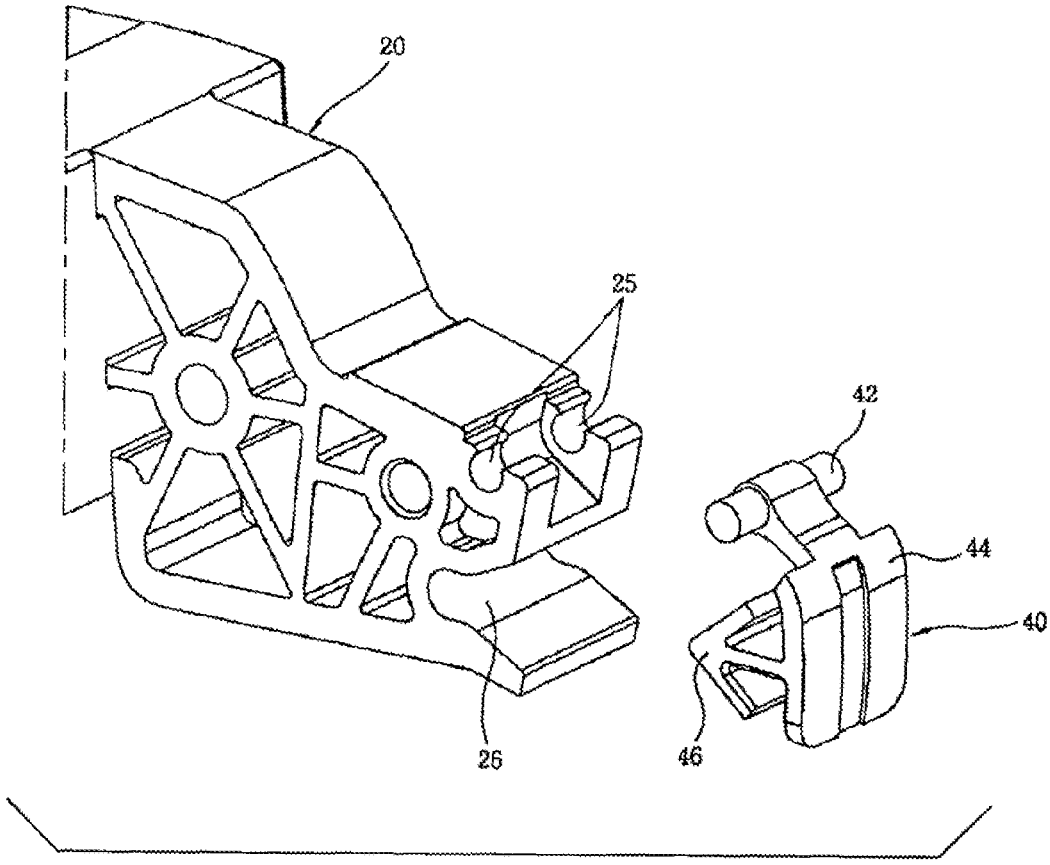
FIG. 6 is an exploded perspective view showing a first friction member, which has been mounted, of a hysteresis adjusting unit.
Figure 7:
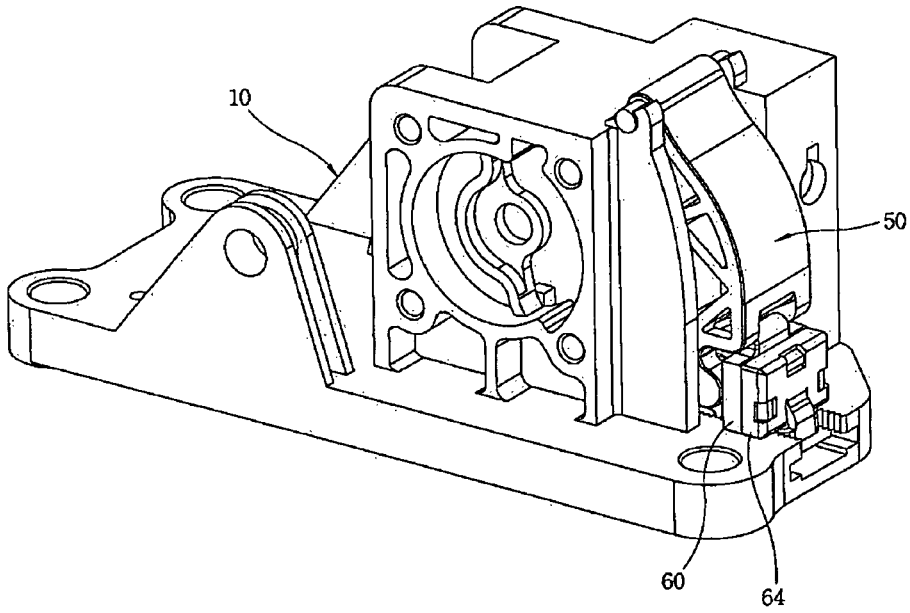
FIG. 7 is a perspective view showing the hysteresis adjusting unit that has been mounted.
Figure 8:
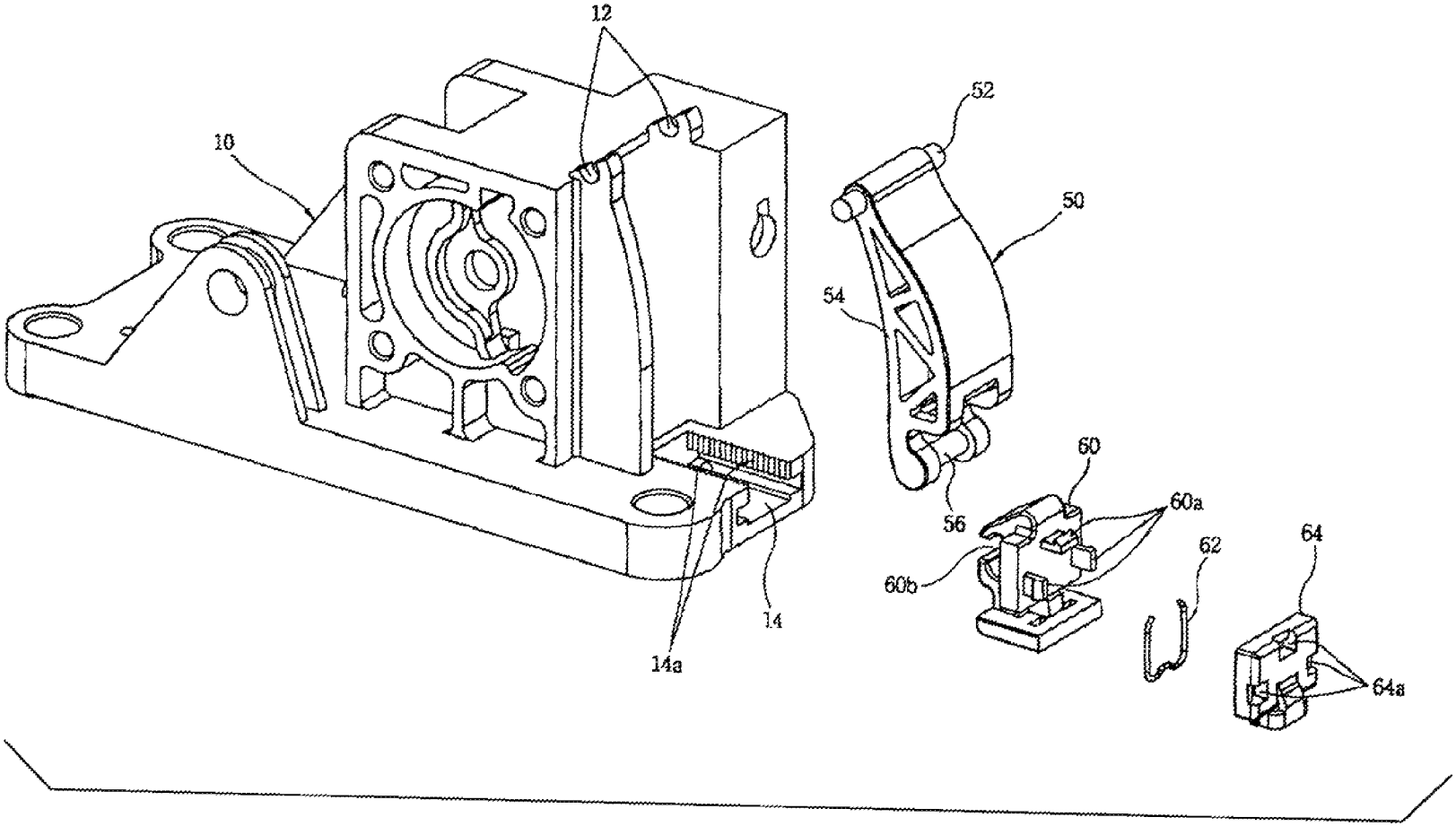
FIG. 8 is an exploded perspective view showing a second friction member and a position adjusting unit, which have been mounted, of the configuration of the hysteresis adjusting unit.
Figure 9:
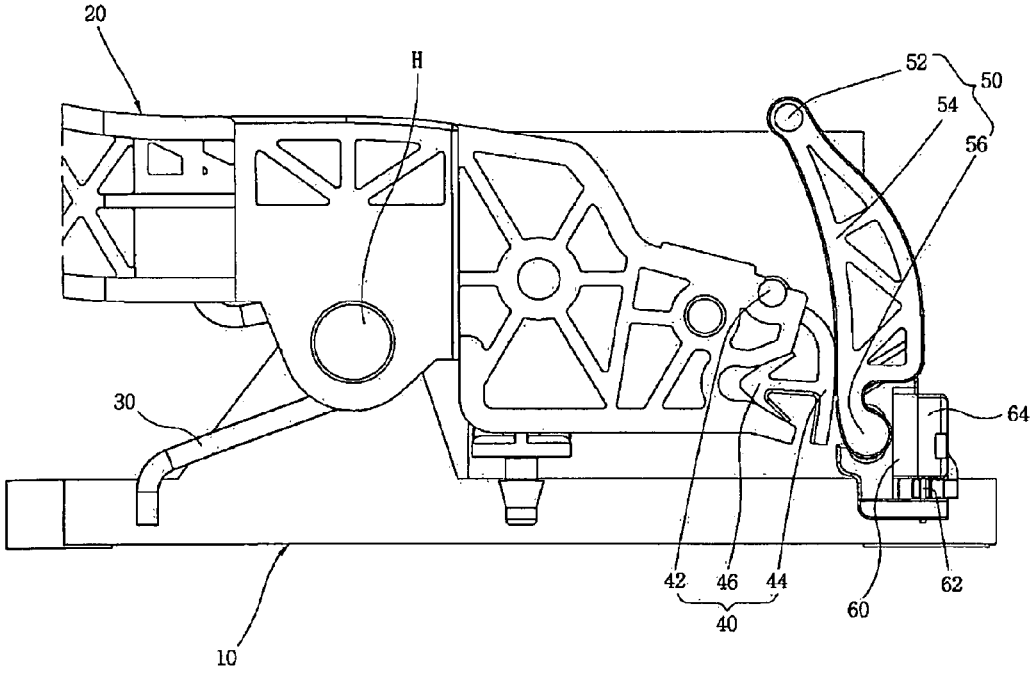
FIG. 9 is a cross-sectional view illustrating the configuration of the hysteresis adjusting unit.

As shown in FIGS. 4 and 5, the pedal effort adjusting unit includes an insert 21 that is inserted and fixed in a through-holes 20*a* formed in the pedal arm 20 and has fastening holes 21*a* formed in the length direction and adjusting bolts 22 that are engaged with the fastening holes 21*a* and press an end of the torsion spring 30. In this case, the adjusting bolt 22 can adjust the amount of pre-compression force to an end of the torsion spring 30, depending on the insertion depth in the fastening hole 21*a* of the insert 21.

Pressing bodies 23 are movably disposed in the through-holes 20*a* formed in the pedal arm 20. The pressing body 23 is in direct contact with the lower end of the adjusting bolts 22 and receives an end of the torsion spring 30, such that the pressing body 23 adjusts the amount of pre-compression force to an end of the torsion spring 30, depending on the insertion depth of the adjusting bolts 22 in the fastening holes 21*a* of the insert 21.

The adjusting bolt 22 has an integrally formed spherical pressing portion 22*a* for contacting with the pressing body 23 at the lower end. The pressing body 23 has a seating groove 23*a* formed at the center that contacts with the spherical pressing portion 22*a* and a slot 23*b* formed across the seating groove 23*a*, at the upper end. Further, the pressing body 23 has a fitting hole 23*c* in which an end of the torsion spring 30 is fitted, at the lower end.

A cap 24 is attached to the insert 21 to prevent exposure of the fastening holes 21*a* of the insert 21 to the outside. Fitting grooves 21*b* are formed at both sides of the insert 21 to attach the cap 24 to the insert 21. Fitting protrusions 24*a* that are fitted in the fit grooves 21*b* are integrally formed with the cap 24.

As shown in FIGS. 6 to 9, the hysteresis adjusting unit includes a first friction member 40 pivotably attached to the pivot end of the pedal arm 20, a second friction member 50 pivotably combined to the housing 10 and contacting with the first friction member 40, and a position adjusting unit provided to vary the fixed position of the second friction member 50 with respect to the housing 10 and adjusting the amount of pressing of the second friction member 50 against the first friction member 40.

The first friction member 40 has a hinged portion 42 fitted in a receiving groove 25 formed at the pivot end of the pedal arm 20, a contact portion 44 integrally extending from the hinged portion 42 and being in surface contact with the second friction member 50, and an elastic protrusion 46 integrally extending from the contact portion 44 and is fitted in a mounting groove 26 formed to have a V-shape at the pivot end, in order to generate an elastic supporting force. The second friction member 50 has an upper hinged portion 52 fitted in a receiving groove 12 formed at the housing 10, a contact portion 54 integrally extending from the upper hinged portion 52 and being in surface contact with the first friction member 40, and a lower hinged portion 56 integrally extending from the contact portion 54 and coupled with the position adjusting unit.

The position adjusting unit includes a guide groove 14 elongated toward the first friction member 40 at an end of the housing 10, a slide block 60 movably inserted in the guide groove 14, and a wire spring 62 fixing a position of the slide block 60 with respect to the guide groove 14. That is, the wire spring 62 is elastically fitted in an engagement portion 14*a* formed on the inner sides of the guide groove 14 and variably fixes the position of the slide block 60 with respect to the guide groove 14. For this, an end of the wire spring 62 is fixed and supported inside the slide block 60 by a fixing block 64 combined with the slide block 60.

A plurality of coupling protrusions 60*a* is formed at the slide block 60 to combine the slide block 60 with the fixing block 64. A plurality of coupling grooves 64*a* receiving the coupling protrusions 60*a* is formed at the fixing block 64. Moreover, a fitting groove 60*b* for fixing the lower hinged portion 56 of the second friction member 50 is formed at the slide block 60.

Meanwhile, though not described, the reference number 70 in the figures represents a pivot angle detecting sensor provided in the housing 10 to electrically detect the amount of pivot of the pedal arm 20 when the pedal is pressed, and output the detected result.

Hereinafter, the operation of the pedal device with a function of adjusting the pedal effort and the hysteresis according to an embodiment of the invention will be described in detail. First, the pedal effort applied to the pedal arm 20 is adjusted by adjusting the adjusting bolts 22 inserted in the fastening holes 21*a* of the insert 21. As the insertion depth of the adjusting bolts 22 in the insert 21 is adjusted, the pre-compression force applied to an end of the torsion spring 30 is correspondingly adjusted, such that the amount of the pedal effort exerted when the pedal arm 20 is operated can be variably adjusted.

Figure 10:
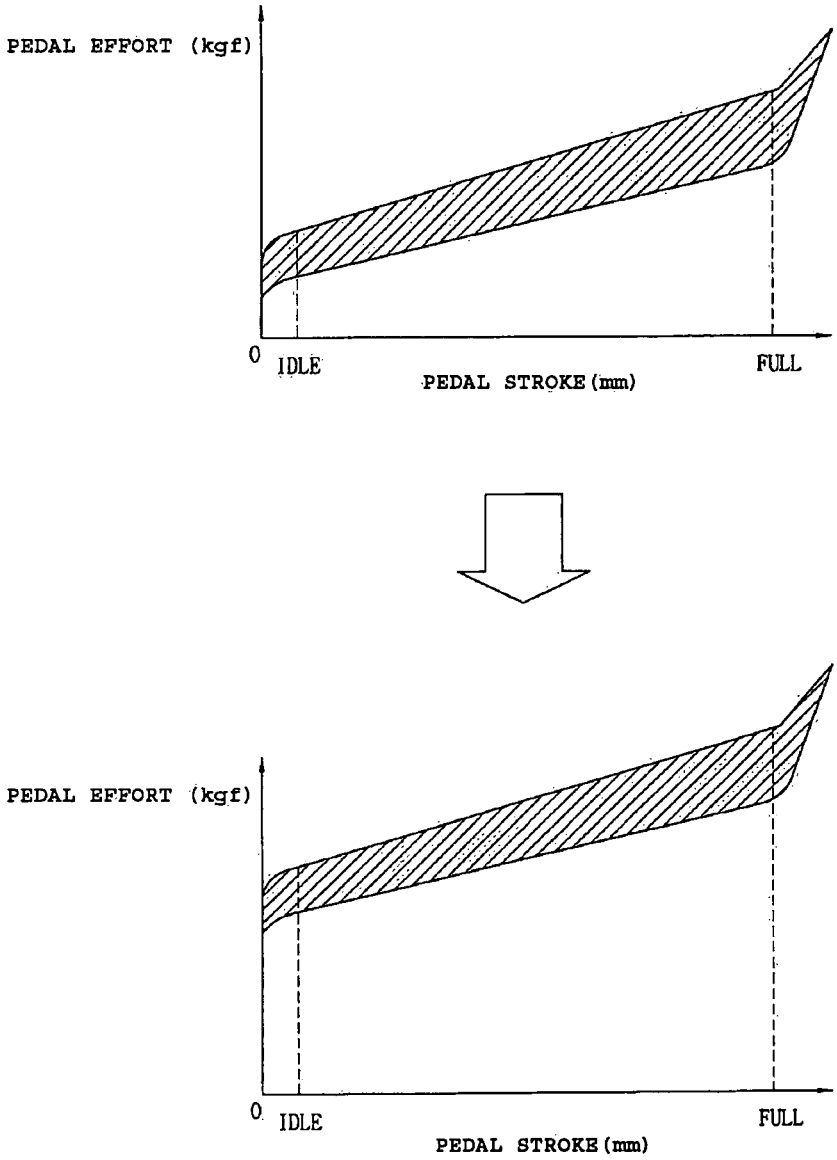
FIG. 10 shows graphs illustrating changes in stroke-to-pedal effort before and after a pedal effort is adjusted, when a pedal operates.

That is, as shown in FIG. 10, as the pre-compression force to the torsion spring 30 is adjusted by adjusting the adjusting bolts 22, the pedal effort-to pedal stroke is varied. In this case, the variation of the pedal effort of the pedal can be properly adjusted within a minute range by adjusting the insertion depth of the adjusting bolts 22 in the fastening holes 21*a* of the insert 21.

Further, adjustment of the hysteresis to the pedal arm 20 is performed by adjusting a friction force generated between the first friction member 40 and the second friction member 50. As the position of the slide block 60 is variably adjusted in the guide groove 14, that is, an engaging position of the wire spring 62 supported between the slide block 60 and the fixing block 64 is varied along the engagement portion 14*a* of the guide groove 14, the amount of contact between the first friction member 40 and the second friction member 50 is variably adjusted, such that the pedal stroke-to-pedal effort when the pedal arm 20 operates is correspondingly varied.

Figure 11:
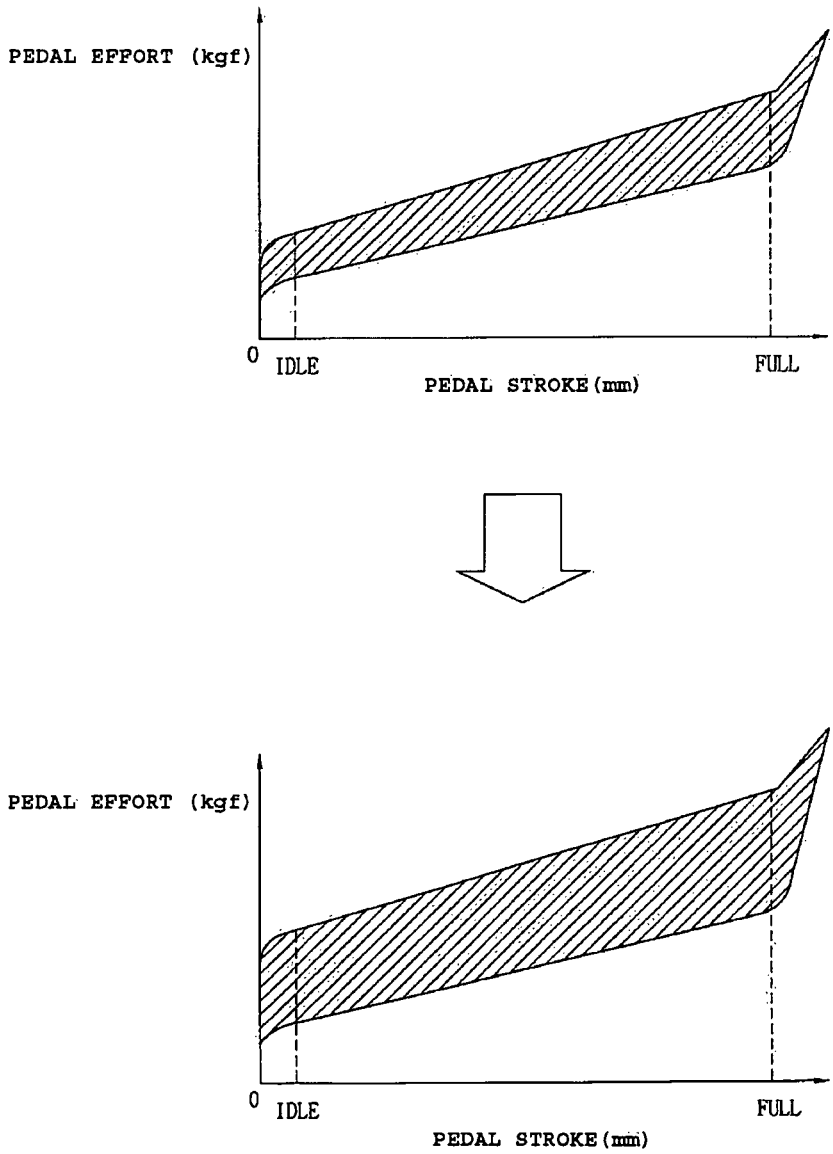
FIG. 11 shows graphs illustrating changes in stroke-to-pedal effort before and after a hysteresis is adjusted while a pedal operates.

That is, as shown in FIG. 11, when the amount of the contact between the first friction member 40 and the second friction member 50 is adjusted by adjusting the position of the slide block 60 with respect to the guide groove 14, the pedal stroke-to-pedal effort is varied as the pedal is pressed and released.

In this case, the variation of the hysteresis of the pedal can be properly adjusted within a minute range by adjusting the position of the wire spring 62 with respect to the engagement portion 14*a* of the guide groove 14.

As described above, by a pedal device having a function of adjusting according to an embodiment of the invention, accumulation of fatigue of a driver's ankle at the time of driving a vehicle can be alleviated by differently setting the amount of reaction force applied when a driver presses are releases the pedal and the amount of reaction force can be flexibly adjusted to adapt to driver's propensity. Therefore it is possible to improve a product value of the pedal device.

Further, according to an embodiment of the invention, a product performance can be stabilized by reducing the dispersion of a quality in producing the pedal device through flexible adjustment of the pedal effort of the pedal device and tuning of operability according to output characteristics of the engine can be easily performed when the pedal device is applied to vehicles of different type vehicles.

What is claimed is:

1. A pedal device with a function of adjusting a pedal effort and hysteresis, the pedal device comprising:

a housing fixed to a car body;

a pedal arm hinged to the housing;

an elastic member disposed at the hinged portion between the housing and the pedal arm, composed of torsion springs, and providing a return force to the pedal arm;

a pedal effort adjusting unit disposed at the pedal arm and pressing an end of the elastic member to adjust a pre-compression force to the elastic member wherein the pedal effort adjusting unit includes:

an insert that is inserted and fixed in through-holes formed in the pedal arm and having fastening holes; and adjusting bolts engaged with the fastening holes and pressing an end of the torsion springs; and a hysteresis adjusting unit movably disposed at the housing to press a pivot end of the pedal arm and adjusting the amount of change in stroke-to-pedal effort when the pedal arm operates, wherein the hysteresis adjusting unit includes a first friction member pivotably combined to a pivot end of the pedal arm, a second friction member pivotably combined to the housing and contacting with the first friction member, and a position adjusting unit provided to vary the fixed position of the second friction member with respect to the housing and adjusting the amount of contact between the second friction member and the first friction member, wherein the position adjusting unit includes a guide groove elongated toward the first friction member at an end of the housing, a slide block movably inserted in the guide groove, and a wire spring elastically engaged and clipped with an engagement portion formed on the inner sides of the guide groove to fix the slide block, and wherein the slide block is configured to he movable by relocating the wire spring along the guide groove, and the movement of the slide block is configured to change the amount of contact between the first friction member and the second friction member.

2. The pedal device as set forth in claim 1, wherein the through-holes include pressing bodies receiving the end of the torsion springs and movably disposed to he in direct contact with the adjusting bolts.

3. The pedal device as set forth in claim 2, wherein the adjusting bolt has an integrally formed spherical pressing portion for contacting with the pressing body at the lower end, the pressing body has a seating groove formed at the center that contacts with the spherical pressing portion and a slot formed across the seating groove, at the upper end, and the pressing body has a fitting hole in which the end of the torsion springs is fitted, at the lower end.

4. The pedal device as set forth in claim 1, further comprising: a cap combined with the insert to prevent exposure of the fastening holes of the insert.

5. The pedal device as set forth in claim 1, wherein the first friction member has a hinged portion fitted in a receiving groove formed at the pivot end of the pedal arm, a contact portion integrally extending from the hinged portion and being in surface contact with the second friction member, and an elastic projection portion integrally extending from the contact portion and fitted in a mounting groove formed to have a V-shape at the pivot end of the pedal, in order to generate an elastic, supporting force.

6. The pedal device as set forth in claim 1, wherein the second friction member has an upper hinged portion fitted in a receiving groove formed at the housing, a contact portion integrally extending from the upper hinged portion and being in surface contact with the first friction member, and a lower hinged portion integrally extending from the contact portion coupled with the position adjusting unit.

7. The pedal device as set forth in claim 1, wherein the wire spring is supported by a fixing block combined with the slide block.

8. The pedal device as set forth in claim 7, wherein a plurality of coupling protrusions is formed at the slide block to combine the slide block with the fixing block, and a plurality of coupling grooves receiving the coupling protrusions is formed at the fixing block.

9. The pedal device as set forth in claim 6, wherein a fitting groove for fixing the lower hinged portion of the second friction member is formed at the slide block.

* * * * *